United States Patent [19]

Kruse

[11] 4,440,430

[45] Apr. 3, 1984

[54] BAG OPENER

[76] Inventor: William A. Kruse, 129 Windsor Ave., Kensington, Calif. 94708

[21] Appl. No.: 215,104

[22] Filed: Dec. 10, 1980

[51] Int. Cl.[3] ..... A47F 13/06

[52] U.S. Cl. ..... 294/1 R; 15/257.1; 150/51; 294/55; 248/95

[58] Field of Search ..... 248/95, 98, 97, 99, 248/100, 101, 150, 151; 150/51, 1; 141/108, 313; 15/257.1, 257.4, 257.9; 294/1 R, 55; 24/256, 259 R, 255 R

[56] References Cited

U.S. PATENT DOCUMENTS

| | | | |
|---|---|---|---|
| 3,697,030 | 10/1972 | Schultz | 15/257.1 X |
| 3,733,099 | 5/1973 | Szita | 294/55 |
| 3,747,653 | 7/1973 | Ringer | 15/257.1 X |
| 3,796,402 | 3/1974 | Trotta | 248/97 |
| 3,866,872 | 2/1975 | Burgess | 248/97 |
| 3,942,832 | 3/1976 | Hass | 294/55 |
| 3,958,785 | 5/1976 | Abound | 248/99 X |
| 3,977,450 | 8/1976 | Schampier | 248/95 X |
| 4,019,707 | 4/1977 | Quinn et al. | 248/95 |
| 4,026,266 | 5/1977 | Cremer | 248/151 X |
| 4,159,139 | 6/1979 | Gawedzinski | 15/257.1 X |

*Primary Examiner*—William H. Schultz
*Assistant Examiner*—Ramón O. Ramírez
*Attorney, Agent, or Firm*—Willis E. Higgins; Edward B. Gregg

[57] ABSTRACT

This bag opener has a ring-shaped portion dimensioned to fit inside the top of a bag. A plurality of substantially straight leg portions extend substantially normal to a plane defined by the ring-shaped portion. The leg portions are dimensioned to extend inside the bag when the ring-shaped portion is in place inside the top of the bag. The bag opener is especially adapted for use in yard work for filling the bag while it lies along the ground. The bag opener is readily removed from the bag without disturbing its contents when the bag is full of leaves, grass or other materials.

3 Claims, 4 Drawing Figures

BAG OPENER

BACKGROUND OF THE INVENTION

1. Field of the Invention

This invention relates to a bag opener for plastic trash bags and other similar bags. More particularly, it relates to such a bag opener of simplified construction especially adapted for filling the bag with a rake or similar implement with the bag lying along the ground. Most especially, it relates to such a bag opener which fits inside the bag to be held open.

2. Description of the Prior Art

The filling of plastic or other flexible bags with trash or other material has long been considered a two-person job, especially in the case of yard work, where the bag is filled with a substantial quantity of material all at once. One person is required to hold the mouth or top of the bag open, and the second person inserts the material into the bag. While one person can fill such bags, it takes considerably longer to do so, especially if there is any wind to blow the top of the bag closed during the filling operation.

In an attempt to alleviate the difficulties of filling trash and similar bags without the use of two persons, various devices have been proposed in the prior art for holding the bags open. For example, Trotta, U.S. Pat. No. 3,796,402 discloses a ring member which fits around the outside of the opening of a bag and to which the top of the bag is clamped in use. This ring can be employed with a stand to support the bag vertically, or horizontally for filling the bag with a rake or similar implement. While this device represents a partial solution for holding a bag open, in use it provides little control over the body of the bag, especially when the bag is horizontally oriented.

Various other bag holers are known in the prior art for supporting collapsible bags open in a vertical position, including those disclosed in Kurlander, U.S. Pat. No. 3,226,070; Owens, U.S. Pat. No. 2,683,009; Nicholas, U.S. Pat. No. 2,639,110; Kliewer, U.S. Pat. No. 3,260,488; Vosbikian, U.S. Pat. No. 3,633,859, and Tomplins et al, U.S. Pat. No. 2,213,937. All of these bag holders incorporate structures provided externally around the bag.

SUMMARY OF THE INVENTION

Accordingly, it is an object of this invention to provide a bag opener of increased convenience especially adapted for use with a bag lying along the ground and which provides positive control over both the bag opening and the bag body.

It is another object of the invention to provide a bag opener which is used by placing it inside a bag to be held open.

It is a further object of the invention to provide such a bag opener which is readily removed from a bag after the bag has been filled, without disturbing the contents of the bag.

It is still another object of the invention to provide such a bag opener which is conveniently stored when not in use.

The attainment of these and related objects may be achieved through use of the novel bag opener herein disclosed. The bag opener of this invention includes a ring-shaped portion dimensioned to fit inside the top of a bag. A plurality of substantially straight leg portions extend substantially normal to a plane defined by the ring-shaped portion. The leg portions are dimensioned to extend inside the bag when the ring-shaped portion is in place inside the top of the bag. In use with a trash bag, the bag opener is inserted into the trash bag, and the bag is oriented horizontally along the ground to fill the bag with a rake or similar tool. Alternatively, the device may be used with the bag in a vertical position.

The attainment of the foregoing and related objects, advantages and features of the invention should be more readily apparent to those skilled in the art after review of the following more detailed description of the invention, taken together with the drawings, in which:

DETAILED DESCRIPTION OF THE INVENTION

Figure 1:
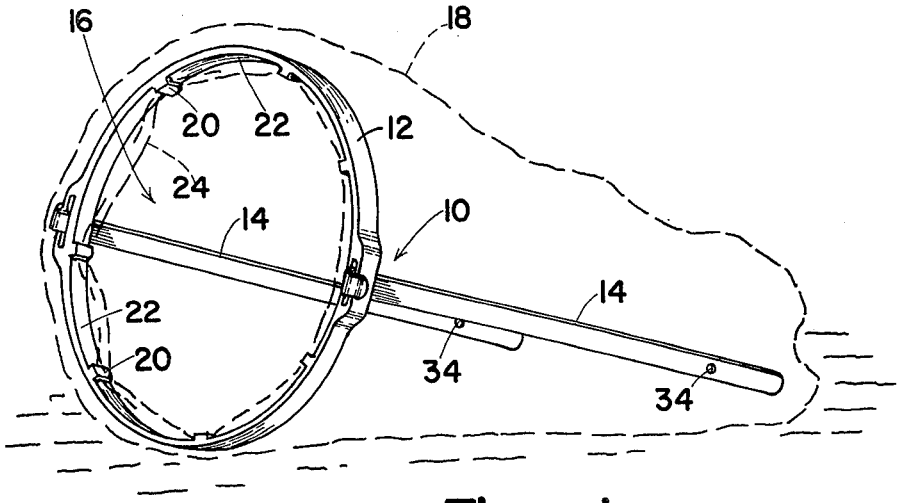
FIG. 1 is a perspective view showing the invention in use.

Turning now to the drawings, more particularly to FIG. 1, there is shown a bag opener 10 in accordance with the invention. The bag opener 10 has a ring-shaped portion 12 and two substantially straight legs 14, which extend substantially normal to the plane defined by ring 12. Ring 12 is dimensioned to fit inside opening 16 of bag 18. Ring 12 has a plurality of clips 20 disposed around its inner surface 22. In the case of a standard large sized plastic garbage bag typically employed for yard work, the ring-shaped portion 12 has a diameter of 18 inches (45.7 cm).

The substantially straight leg portions 14 are dimensioned to fit inside the bag 18 when the ring portion 12 is placed inside the top 16 of the bag. For the large, plastic garbage bag, the leg portions 14 should have a length of about 30 inches (76.2 cm).

In use, ring-shaped portion 12 is inserted in the opening 16 of bag 18, with leg portions 14 extending into the bag. Top 24 of the bag is then folded over the ring-shaped portion 12 and inserted into clips 20 to hold the bag 18 in place. The bag may then be rested horizontally along the ground, as shown in FIG. 1, for filling through use of a lawn rake or similar implement. The ring-shaped portion 12 assures that opening 16 remains unobstructed during the filling operation, and the leg portions 14 provide positive control of the remainder of bag 18, even under windy conditions. The bag is preferably held in the position shown in FIG. 1 with one hand and the rake used with the other hand to direct leaves, grass and similar materials into the bag 18. Alternatively, the bag may be placed in an upright position by leaning it against a tree or other suitable support for convenient filling with both hands, until there is enough material in the bag to allow it to stand upright. Providing three or more of the leg portions 14 will also facilitate using the bag in an upright position without other support.

Figure 2:
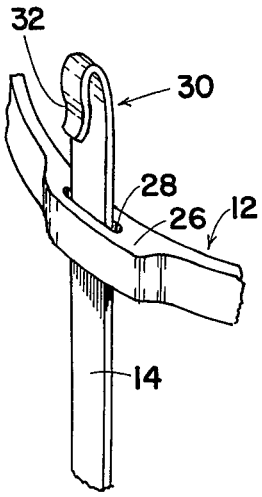
FIG. 2 is a perspective view of a portion of the invention as shown in FIG. 1, to show detail.

FIG. 2 shows a preferred construction detail for the ring-shaped portion 12 and the leg portions 14. Strip 26 has an opening 28 passing through it substantially normal to the plane defined by the ring-shaped portion 12. The opening 28 is dimensioned to receive the leg portion 14. The upper end 30 of the leg portion 14 has a clip 32 dimensioned to engage wall 26 of the ring-shaped portion 12 to fasten the leg portion 14 securely to the ring-shaped portion 12.

The bag opener 10 may be fabricated of any suitable material, such as a metal or plastic, having a sufficient rigidity to support the bag 18. A preferred material is polyvinyl chloride plastic. With use of polyvinyl chloride, both the clips 20 and 32 can be integrally formed with their respective ring-shaped portion 12 and leg portion 14, which may be molded using techniques known in the plastic fabrication art.

Figure 3:
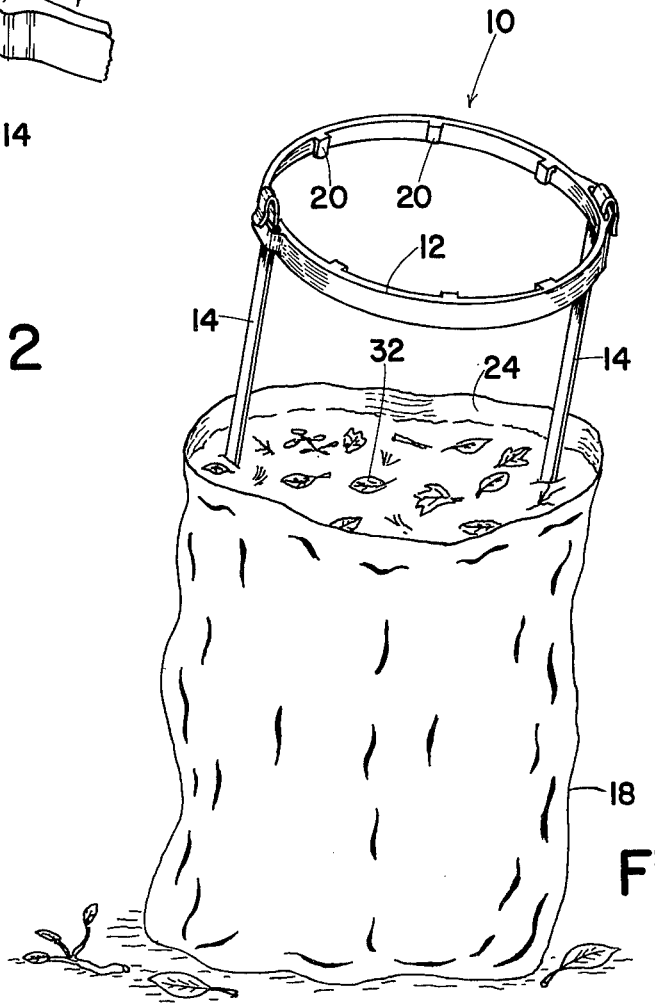
FIG. 3 is a perspective view of the invention at the completion of its use.

FIG. 3 shows that the bag opener 10 may be readily removed from the bag 18 when it is full of leaves 32 or similar material. Top 24 of the bag 18 is unfastened from clips 20 on ring-shaped portion 12, and the bag opener 10 is lifted upwards from the full bag 18. Because the leg portions 14 contain no projections to engage the leaves 32, they slide easily out of the bag 18. The portion of the top 24 of the bag 18 that was folded over the ring-shaped portion 12 for insertion into clips 20 helps to assure that there is sufficient extra length to the bag 18 to allow ready closure of the top 24.

Figure 4:
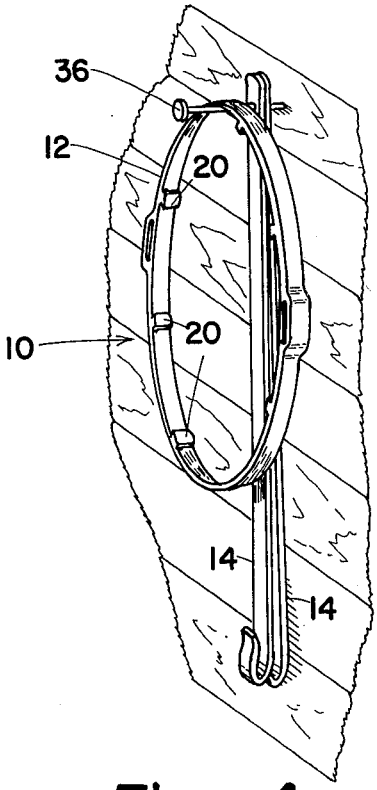
FIG. 4 is a perspective view showing storage of the invention.

FIG. 4 shows how the bag opener 10 may be stored in a convenient manner when not in use. As is best shown in FIG. 1, the leg portions 14 have apertures 34 near their ends remote from the ring-shaped portion 12. These apertures allow the leg portions 14 to be hung from nail 36 or other suitable support, over which the ring-shaped portion 12 may also be hung.

It should now be apparent to those skilled in the art that a bag opener capable of achieving the stated objects of the invention has been provided. This bag opener is particularly convenient in use and adapted for use with the bag lying along the ground while also providing positive control of both the bag opening and the bag body. Unlike prior art bag openers, this bag opener is placed inside the bag, yet is readily separated from the bag and removed after it has been filled. The construction of the bag opener also facilitates its storage when not in use.

It should further be apparent to those skilled in the art that various changes in form and details of the invention as shown and described may be made. It is intended that such changes be included within the spirit and scope of the claims appended hereto.

What is claimed is:

1. A bag opener for a flexible bag, which comprises: a ring-shaped portion dimensioned to fit inside a top of a bag, said ring-shaped portion being defined by an enclosed strip having sides extending normally to a plane defined by the ring-shaped portion, said ring-shaped portion having a plurality of apertures, each with a wall parallel to the sides of the enclosed strip, and a plurality of substantially straight leg portions extending through each of the apertures, being substantially normal to the plane defined by said ring-shaped portion and dimensioned to extend inside the bag to a point proximate to a bottom of the bag when said ring-shaped portion is inside the top of the bag, each of said leg portions having a top end extending around to form a clip with a side of the leg portion, the top end and side of the leg portion engaging the aperture wall and one of the strip sides to hold said leg portion in a fixed relationship relative to said ring portion.

2. The bag opener of claim 1, in which each leg portion is provided with a hole extending through it, so that said leg portions and ring portion may be stored by hanging them from a common support.

3. The bag opener of claim 1 additionally comprising a plurality of clips on said ring-shaped portion configured to engage the top of the bag when said ring-shaped portion is inside the top of the bag.

* * * * *